US007021625B2

(12) United States Patent
Simmons

(10) Patent No.: US 7,021,625 B2
(45) Date of Patent: Apr. 4, 2006

(54) THREE-DIMENSIONAL PUZZLE

(76) Inventor: Terry L. Simmons, 2500 Alder #212, Milton, WA (US) 98354

( * ) Notice: Subject to any disclaimer, the term of this patent is extended or adjusted under 35 U.S.C. 154(b) by 0 days.

(21) Appl. No.: 10/268,199

(22) Filed: Oct. 9, 2002

(65) Prior Publication Data

US 2003/0173738 A1 Sep. 18, 2003

Related U.S. Application Data

(60) Provisional application No. 60/363,741, filed on Mar. 12, 2002.

(51) Int. Cl.
*A63F 9/12* (2006.01)

(52) U.S. Cl. ..... 273/157 R

(58) Field of Classification Search ..... 273/157 R, 273/153 R, 156
See application file for complete search history.

(56) References Cited

U.S. PATENT DOCUMENTS

| | | | | |
|---|---|---|---|---|
| 1,381,957 A | | 6/1921 | Anderson | |
| 2,897,318 A | | 7/1959 | Finch | 200/122 |
| 2,957,251 A | | 10/1960 | Nystad et al. | 35/46 |
| 2,987,318 A | | 6/1961 | Hammer | 273/157 |
| 3,578,331 A | | 5/1971 | DeGast | 273/157 R |
| 3,618,955 A | * | 11/1971 | Barnes | 273/157 R |
| 3,704,892 A | | 12/1972 | Moravick et al. | 273/157 R |
| 3,851,884 A | | 12/1974 | Myller | 273/157 R |
| 4,037,846 A | | 7/1977 | Zeeman | 273/157 R |
| 4,371,166 A | * | 2/1983 | Ferris et al. | 273/157 R |
| 4,494,935 A | | 1/1985 | Miller | 434/132 |
| 4,874,176 A | | 10/1989 | Auerbach | 273/157 R |
| 5,165,689 A | | 11/1992 | Forsse et al. | 273/157 R |
| 5,823,531 A | | 10/1998 | Huber | 273/156 |
| 5,840,377 A | * | 11/1998 | Donnell | 273/157 R |
| 6,015,150 A | | 1/2000 | Giguère | 273/157 R |
| 6,073,929 A | | 6/2000 | Nahon | 273/156 |

* cited by examiner

*Primary Examiner*—Steven Wong
(74) *Attorney, Agent, or Firm*—Seed IP Law Group PLLC

(57) ABSTRACT

A three-dimensional puzzle of a familiar object, the puzzle including a support structure having the shape of the familiar object and a plurality of rigid, non-planar interlocking pieces that engage an outer surface of the support structure to form a representation of the familiar object. The familiar object may be a beverage container such as a soda can, a bottle or a coffee mug, or it may be an apple, a baseball, a model car, or a model of a familiar landmark. The puzzle may include a release mechanism for separating the puzzle pieces from the support structure.

28 Claims, 8 Drawing Sheets

THREE-DIMENSIONAL PUZZLE

CROSS-REFERENCE TO RELATED APPLICATION

This application claims the benefit of U.S. Provisional Patent Application No. 60/363,741 filed Mar. 12, 2002, where this provisional application is incorporated herein by reference in its entirety.

BACKGROUND OF THE INVENTION

The present invention relates to the field of puzzles, and more particularly to the field of three dimensional puzzles.

1. Field of the Invention

2. Description of the Related Art

Many three-dimensional puzzles utilize pieces that interlock to form a structural or decorative shape. An example of this is found in U.S. Pat. No. 6,085,067, which describes interlocking planar elements united through male-female joints into predetermined three-dimensional configurations.

Another form of puzzle utilizes a variety of connector elements for interconnecting the decorative and structural elements into a predetermined three-dimensional shape. U.S. Pat. No. 6,015,150 illustrates this form of puzzle as being a kit of parts that includes of generally flat structural and decorative components for forming a three-dimensional puzzle.

U.S. Pat. No. 2,987,318 describes a three-dimensional puzzle having a base form for receiving projecting pegs on puzzle pieces forming a predetermined shape. The pieces are configured to interlock with each other and with a central portion. These puzzles require assembly in a predetermined order and do not complement the same detail, shape, dimensions, feel and appearance of an existing object.

A disadvantage of previous designs is the complexity and resulting high cost of design and manufacture. In addition, previous three-dimensional puzzles do not have the same exterior detail, shape, dimensions, feel, and appearance of the original object.

BRIEF SUMMARY OF THE INVENTION

An embodiment of the invention provides a three-dimensional puzzle that has a support structure with a three-dimensional shape in substantially the same configuration as the puzzle appears when complete, and a plurality of rigid, non-planar interlocking pieces having a substantially uniform thickness and configured to be coupled to an outer surface of the support structure and to conform to features thereof, completing, thereby, a representation of a familiar object or a model thereof. The familiar object may be a beverage container such as a soda can, a bottle, or a coffee mug. Other objects include an apple, a baseball, candy bars, a model car, and models of popular landmarks that can be used for sale and display. The puzzle may include a release mechanism for separating the puzzle pieces from the support structure.

Another embodiment of the invention provides a beverage container, including a cavity configured to receive a beverage, a recessed region on an outer surface of the container, and a plurality of interlocking puzzle pieces configured to be coupled to the container in the recessed region.

One embodiment of the invention provides a method of manufacture of a three-dimensional puzzle, including the steps of making a mold of the familiar object, casting a likeness of the familiar object, the likeness having a hollow interior, cutting the likeness into interlocking pieces, removing a portion from an inner surface of each of the pieces to create an impression therein, reassembling the pieces into the likeness, and casting a support structure within the hollow interior of the likeness that conforms to the topography of the interior.

An alternative method includes the step of forming a release mechanism inside the support structure configured to disengage at least one of the puzzle pieces from an outer surface of the support structure.

BRIEF DESCRIPTION OF THE SEVERAL VIEWS OF THE DRAWINGS

The foregoing and other features and advantages of the present invention will be more readily appreciated as the same become better understood from the following detailed description when taken in conjunction with the accompanying drawings, wherein like elements are referred to with like reference numbers, and further wherein.

DETAILED DESCRIPTION OF THE INVENTION

Figure 1:
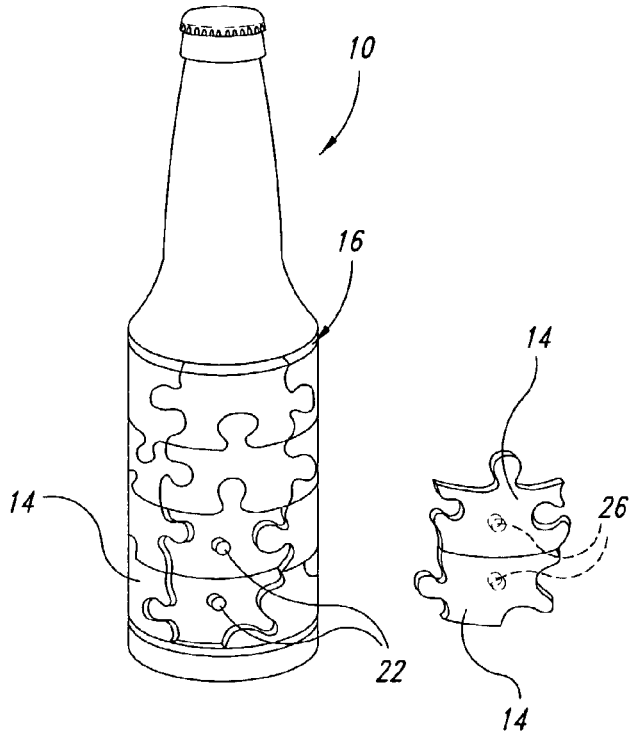
FIG. 1 is a side plan view of a beverage bottle puzzle having mid-section puzzle pieces in partially-disassembled configuration illustrating the general concept of the present invention.
Figure 2A:
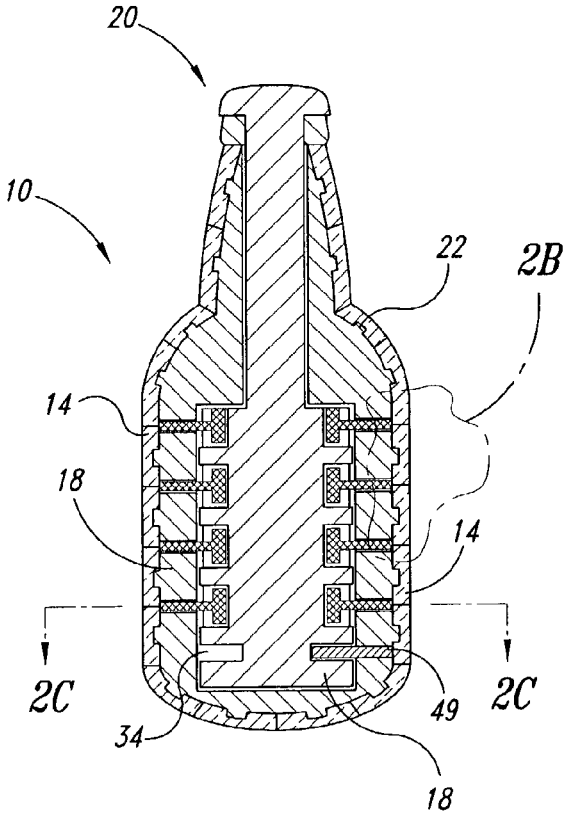
FIGS. 2A–2C are a partial cross-sectional side view and two enlarged sections, respectively, of the bottle puzzle of FIG. 1.

A first embodiment of the invention is described with reference to FIGS. 1–3. Referring initially to FIG. 1, shown therein is a beverage bottle puzzle 10. A plurality of puzzle pieces 14 are shown attached to a mid-section 16 of the bottle 10. Several of these pieces 14 are shown removed.

Referring next to FIGS. 2A–2C, and FIG. 3, the bottle puzzle 10 is shown in assembled and disassembled form, respectively, and includes the puzzle pieces 14 assembled to a structural support or substrate 18 that has a release component 20 rotatably mounted therein. According to an embodiment of the invention, the structural assembly 18 is substantially a scale model of the original object with provisions for retention and release devices or components.

Figure 2B:
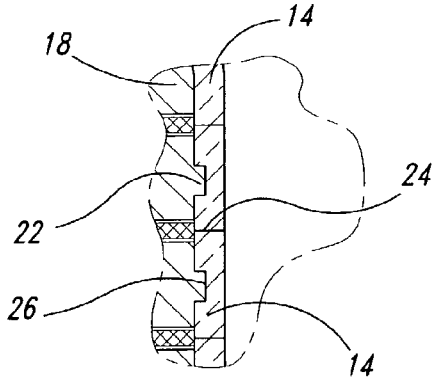

FIG. 2B shows in detail the puzzle pieces 14 snapped in place onto protrusions 22 that are formed on an exterior surface 24 of the structural support 18. Ideally, the puzzle pieces 14 lock to each other using conventional jigsaw puzzle techniques. Each piece 14 also includes an impression 26 formed on a back surface 28 thereof that is sized and shaped to slidably receive the protrusion 22 with a tight fit. The back surfaces 28 of pieces 14 are also shaped to make contact with the corresponding exterior surface of the substrate 18.

Figure 2C:
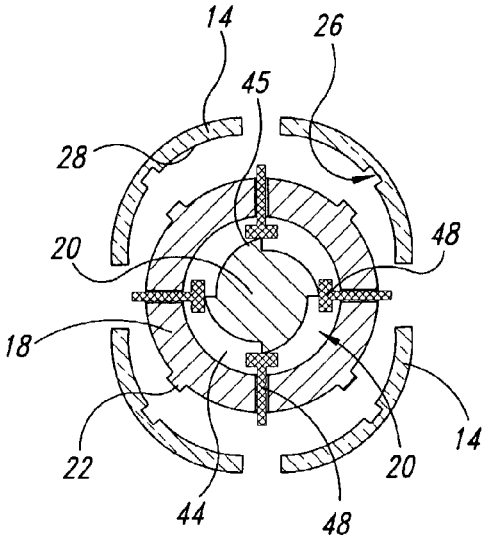

FIG. 2C shows in detail how the release pins 48 interact with the puzzle pieces 14 to force them away from the adjacent pieces and off the protrusion 22 when release component 20 is rotated and the depth of lateral grooves 44 diminishes as the cam lobe 45 rotates under the release pins.

Figure 3A:
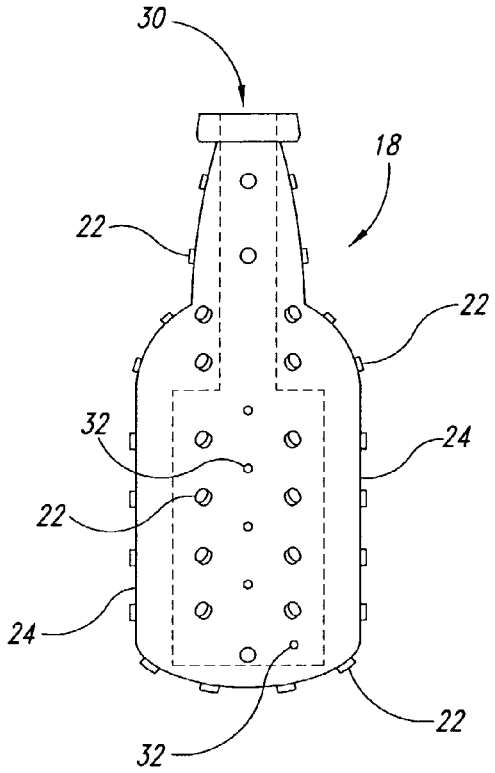
FIGS. 3A and 3B are side views of the support structure and the release mechanism of the bottle puzzle of Figure, respectively 1.
Figure 3B:
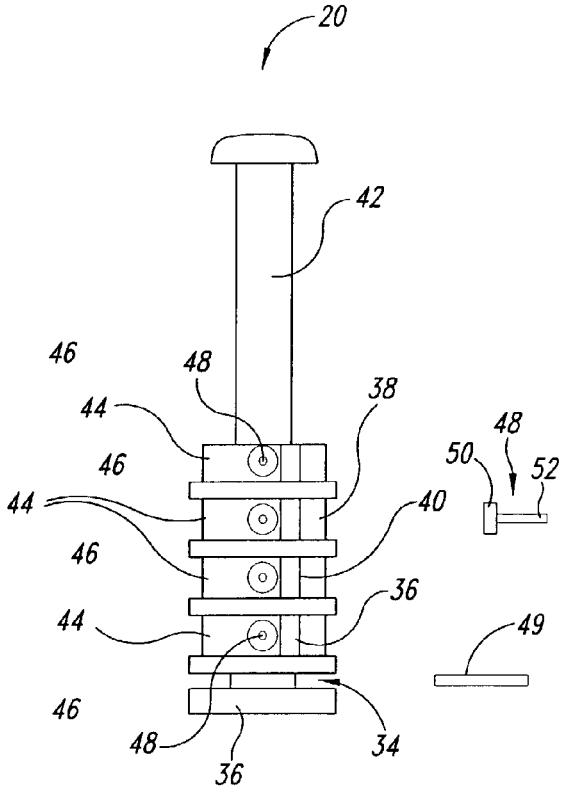

Shown disassembled in FIGS. 3A and 3B are the structural support 18 and the release component 20. The structural support 18 has a plurality of the protrusions 22 formed on portions of the exterior surface 24 of the structural support 18 where the puzzle pieces 14 are to be positioned. This structural support 18 includes a hollow interior 30 that is sized and shaped to hold the release component 20. Openings 32 are formed in the structural support 18 that communicate with the interior 30 thereof.

The release component 20 is formed to have a cylindrical shape with a retaining groove 34 circumscribing a lower portion 36. A longitudinal groove 38 is formed on the surface 40 of the lower portion 36 to extend from the lower portion 36 to a reduced circumference portion 42. Extending laterally from the longitudinal groove 38 are four lateral grooves 44 having a depth that diminishes from the longitudinal groove to a lateral end section 46 forming, as illustrated cross sectionally in FIG. 2C, a series of cams, having at least one lobe 45. Alternatively, the release component 20 may be formed such that the entire length of the lower portion 36 has a cross section similar to that shown in FIG. 2C, without intervening lateral grooves or other features. A pin 48 having a head end 50 of substantially greater diameter than a body portion 52 is inserted into each lateral groove 44, which lateral grooves 44 are sized to receive the head end 50 of the pin 48. When assembled, the release component 20 is rotatably mounted in the interior 30 of the structural support 18 with the pins 48 mounted therein so that the body portion 52 projects into the corresponding opening 32. A retention pin 49 holds the release component 20 in place inside the structural support 18. As shown in FIG. 2C, rotation of the release component 20 in the appropriate direction, in this case counterclockwise, causes the pins 48 to project through the openings 32 and urge the puzzle pieces 14 to disconnect from the protrusions 22 and to release engagement with adjacent puzzle pieces 14.

According to one embodiment of the invention, a method of manufacture of the puzzle described with reference to FIGS. 1–3 is as follows: a mold of the object is formed to conform to the contour and detail of the original object or model in every detail except for an area designated for assembly. Such mold may be designed to cast only a thin layer of the exterior of the object or a solid casting.

Following formation of the mold, liquid plastic is then poured into the interior of the mold and allowed to cure. When the casting is solid, it is hollowed out to leave only a thin layer of the exterior of the object. The thin layer from either casting method described above is then cut into individual jigsaw-type puzzle pieces 14. The individual jigsaw puzzle pieces 14 are drilled to form the impression 26. The puzzle pieces 14 are then assembled into a jigsaw portion that resembles the original object.

The structural support 18 is then cast inside the assembled jigsaw pieces using conventional casting techniques. When the casting of the structural support 18 is cured, the individual puzzle pieces 14 are removed.

The release component 20 is then cast inside the structural support 18, which has previously been hollowed out. When the casting of the release component 20 is cured, a top portion of the release component 20 is cut off to enable separation of the release component 20 from the structural support 18.

The openings 32 for the release pins 48 and a retention pin 49 are formed, such as by drilling, in the structural support 18. The retaining groove 34, longitudinal groove 38, and the plurality of lateral grooves 44 are then machined into the surface of the release component 20 to match the location of the openings 32 in the structural support 18. The longitudinal groove 38 is preferably machined to a depth that allows for passage of the release pins 48 on assembly of the release component 20; and the lateral grooves 44 are machined from the depth of the longitudinal groove 38, at the start of the machining process, to a point where the lateral grooves 44 are diminished to meet the surface of the release component 20. The retaining groove 34 is machined to a uniform depth in the surface of the release component 20 to enable rotation of the release component 20 with the retention pin 49 in place.

The release pins 48 are inserted into the openings 32 in the structural support 18, and the release component 20 is assembled into the structural support 18. The top portion of the release component 20 is reattached and the retention pin 49 is inserted through an opening 33 in the structural support 18.

The individual puzzle pieces 14 are then attached to the structural support 18 by aligning them with adjacent puzzle pieces 14 and with the impression 26 aligned with a corresponding protrusion 22. Sufficient pressure is applied to snap the puzzle pieces 14 into position on the structural support 18.

The puzzle 10 is now complete and matches the contour and detail of the original object or model. As such, it is ready for labeling and packaging.

To disengage the puzzle pieces 14 from the structural support 18, the release component 20 is turned counterclockwise until the bottom surface of the machined lateral grooves 44 in the release component 20 make contact with and push the release pins 48 outward through the openings 32 in the structural support 18, thereby forcing the individual puzzle pieces 14 to release from the protrusions 22, as illustrated in FIG. 2C.

Reassembly requires that the release component 20 be rotated clockwise to a position where the release pins 48 are allowed to recess into the corresponding lateral grooves 44 in the structural component 20. The individual puzzle pieces 14 can then be reattached.

The method described above is one possible method of manufacture. Other acceptable methods include injection molding of each piece of the puzzle individually, or molding of the structural support separately from the pieces. Further alternative methods may be employed without departing from the scope of the invention.

Figure 4A:
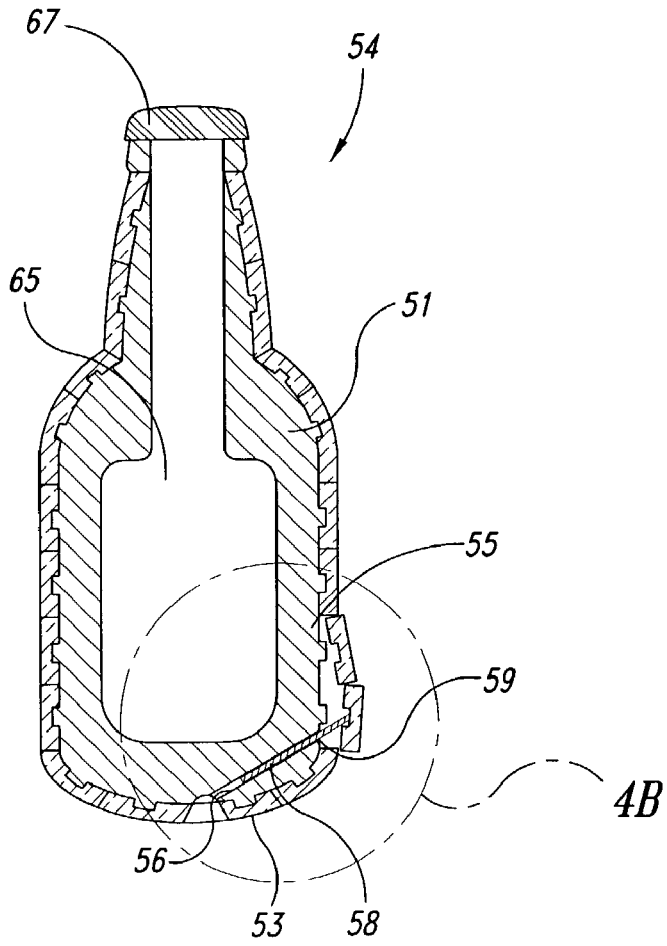
FIGS. 4A and 4B are partial sectional views of an alternative embodiment of a bottle puzzle and a detail of the release mechanism, respectively.
Figure 4B:
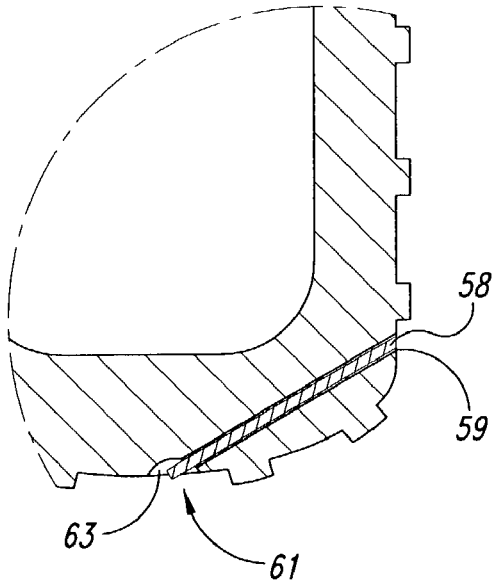

An alternative release mechanism is illustrated in FIGS. 4A and 4B. Shown therein is a puzzle 54 in the shape of a beverage bottle, similar to the puzzle 10 illustrated in FIGS. 1–3. An aperture 56 is provided, passing from one surface of the puzzle 54 to another. In the illustrated embodiment, the aperture 56 passes from a bottom surface 53 to a side surface 55 of the support structure 51. The aperture emerges on the side 55 in a position that corresponds to the position of one of the puzzle pieces 14 when the puzzle 54 is assembled. A release rod 58 passes through the aperture 56 from an end 57 that protrudes slightly from the bottom 53 of the puzzle to terminate substantially flush with the side 55 of the puzzle 54. When the puzzle 54 is assembled, a puzzle piece 14 covers the side opening 59 of the aperture 56. By pressing against the protruding portion 57 of the release rod 58, the rod 58 is caused to extend from the aperture 56 on the side 55 to cause the piece 14 covering the opening 59 to detach from the puzzle 54. In this way, a first piece 14 of the puzzle 54 may be removed. Additional pieces 14 surrounding the position of the first piece 14 may now be pried from the support structure 51 with a finger, continuing in this fashion until all the puzzle pieces 14 are removed. A depression 61 may be formed around the opening 63 of the aperture 56 aperture at the bottom 53 of the support structure 51, which allows the release rod 58 to protrude from the opening 63 in the depression 61 while still remaining approximately flush with the bottom surface of the puzzle 54.

Also illustrated in FIG. 4 is a cavity 65 formed in the puzzle 54 suitable for containing a liquid. In this embodiment of the invention, a beverage may be placed in the cavity 65 and the cavity 65 closed using a standard bottle cap 67. The puzzle 54 may be configured to receive either a screw-off type or pop-off type bottle cap. This embodiment may be exploited by a soft drink bottler or beer bottler, for example, to conduct a sales campaign in which puzzles according to an embodiment of the invention are provided as promotional tools. The puzzles are marked with the livery of the bottler and contain a portion of the product being touted.

Figure 5:
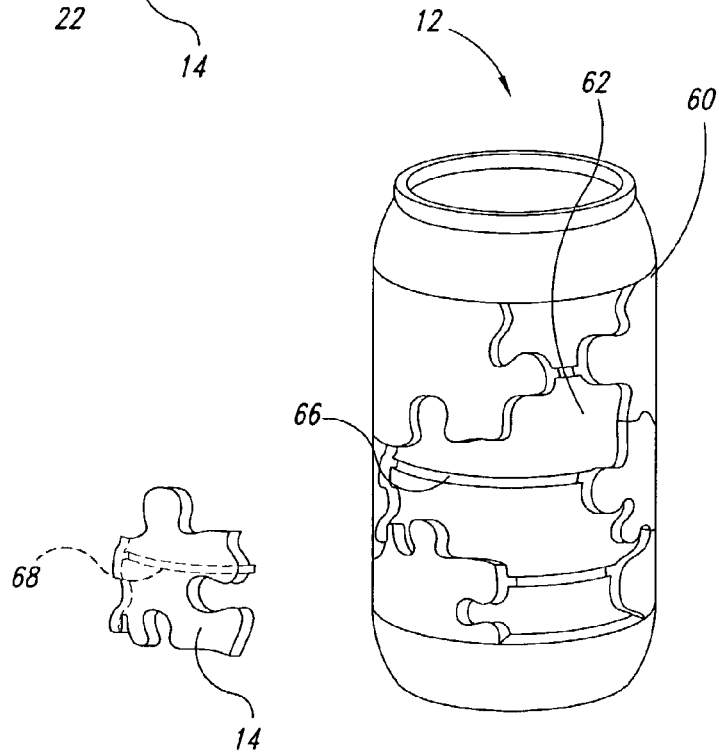
FIG. 5 illustrates an embodiment of the invention in the shape of a soda can.

It will be recognized that, while the embodiments of the invention described with reference to FIGS. 1–4 are shown in the shape of a bottle, the object represented by a puzzle according to the invention may be any of a large variety of objects. For example, FIG. 5 illustrates an embodiment in which the puzzle is in the form of a can 12 of the type commonly used for soft drinks. A recessed region 60 is provided around a midsection of the puzzle 12, into which the puzzle pieces 14 are assembled. The thickness of the individual pieces 14 is substantially equal to the depth of the recessed region 60. Thus, when the puzzle 12 is completely assembled, the result is a dimensionally accurate representation of a soda can.

FIG. 5 illustrates an embodiment of the invention in which the puzzle 12 is in the shape of a soda can. A recessed region 60 is formed around a perimeter of the puzzle 12 and the puzzle pieces 14, when assembled onto the substrate 62, fit into the recessed region. An alternative means for coupling the puzzle pieces to the substrate is illustrated in FIG. 5 as described in more detail with reference to FIG. 6.

Figure 6:
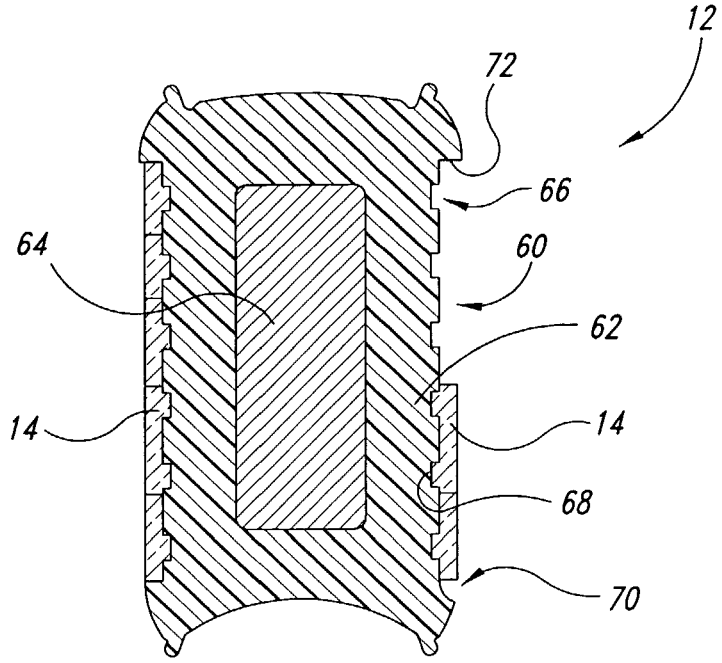
FIG. 6 is a sectional view of the embodiment of FIG. 5.

FIG. 6 is a cross section of the puzzle 12 where the body 62 of the puzzle 12 is shown as a substrate in which the recessed region 60 is formed and on which a plurality of puzzle pieces 14 are supported. In the illustrated embodiment, a weight 64 is provided to give to the puzzle 12 a weight and balance approximately equal to that of a filled soda can. Each of the puzzle pieces 14 is provided with means for coupling the pieces 14 to the body 62. In this embodiment, the recessed region 60 includes a series of grooves or ridges 66 circumscribing the body 62 and spaced at regular intervals. Features 68 formed on a backside of each of the pieces 14 are configured to snugly engage the grooves to hold the pieces 14 in place. A thumb notch 70 is provided in a portion of the sidewall 72 of the recess 60 to permit removal of one of the pieces 14. With a first piece removed, a succeeding piece of the plurality of pieces 14 may then be removed in a similar fashion. Alternatively, one of the pieces 14 may have a gap provided, into which a finger may be inserted to pull a first piece 14 away from the body 62.

As may be seen with reference to FIGS. 2, 4, 6, 7, 8, and 9, the inner surface of each of the puzzle pieces 14 may be integrally formed with features, such as the features 68 of FIG. 6, or the depressions 26 of FIG. 2, configured to matingly engage features formed on the outer surface of the respective substrate, such as the grooves 66 of FIG. 6, or the protrusions 22 of figure 2. As may be seen in the above referenced figures, according to some embodiments, interpenetration of the engaging features is at a depth that is less than the overall thickness of the respective puzzle piece.

According to one embodiment of the invention, the body is manufactured in a manner similar to the embodiments described with reference to FIGS. 1–4. In another embodiment, the body 62 is formed of aluminum and is manufactured using methods commonly used by manufacturers of soft drink cans. The body 62 is formed as a soft drink container and has the recessed region 60 and ridges 66 formed as features of the aluminum can. The puzzle pieces 14 are manufactured separately and configured to engage the ridges 66 formed in the sides of the aluminum body, and they are marked with the trade dress of a soft drink manufacturer. In this way, when the puzzle is fully assembled, it resembles and functions as a standard beverage container sold by the respective manufacturer, and it also functions as a three-dimensional puzzle according to an embodiment of the invention.

Various embodiments of the invention are described with reference to FIGS. 7–12.

Figure 7:
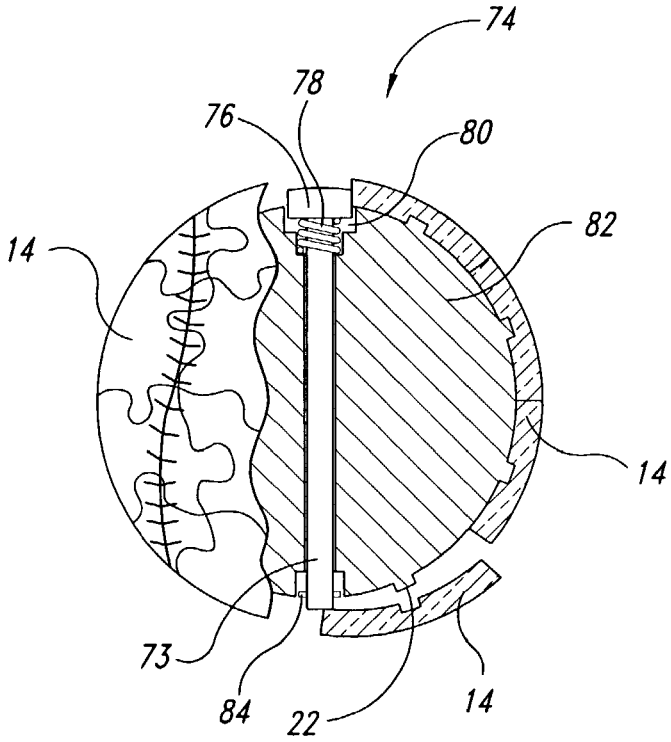
FIG. 7 is a side view of a partially disassemble baseball formed in accordance with another embodiment of the invention.

FIG. 7 shows a sectional view of a three-dimensional jigsaw puzzle 74 made according to an embodiment of the invention and having the dimensions, texture, and markings of a major league baseball. This embodiment may be manufactured utilizing the same manufacturing methods described previously. The baseball puzzle utilizes a single spring-loaded release pin 73 attached to one of the baseball jigsaw puzzle pieces 76. Finger or other pressure pushing on the puzzle piece compresses the spring 78, allowing the puzzle piece to move into a recessed area 80 in the structural assembly 82. This forces one or more jigsaw puzzle pieces 14 off their structural protrusions 22 and away from the adjacent jigsaw puzzle pieces 14, allowing easy removal of the remaining puzzle pieces 14. The spring 78 forces the release pin 73 back into its neutral position when pressure is released. The release pin 73 utilizes a detente pin 84 as a stop on the end opposite the spring 78 to prevent the release pin 73 from coming fully out of the structural assembly 82. As in other embodiments, the baseball puzzle 74 may be internally weighted to closely approximate the weight and balance of the object from which it is patterned, resulting, in this embodiment, in an object that may be mistaken for an actual major league baseball, complete with coloring and marking, stitching, surface texture, and weight of the genuine article.

Figure 8A:
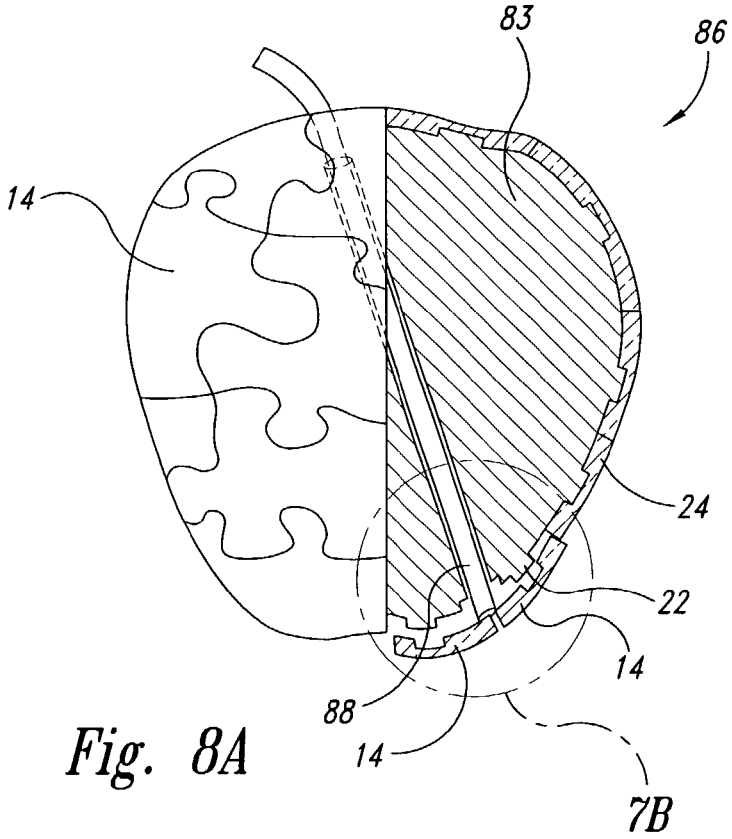
FIG. 8A is a side view of a partially disassembled apple puzzle formed in accordance with another embodiment of the invention.
Figure 8B:
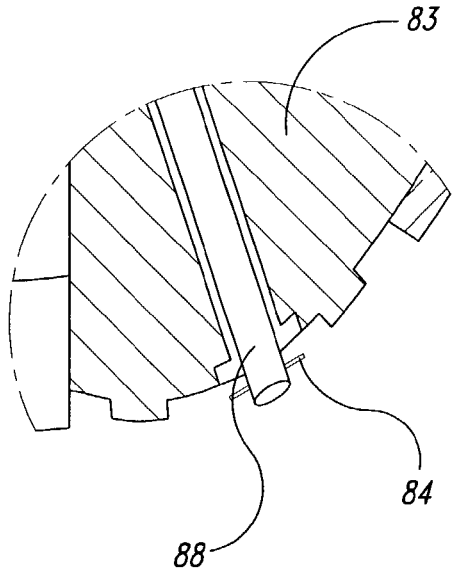
FIG. 8B is an enlarged sectional view of the pushpin stop assembly of the apple puzzle of FIG. 8A.

FIG. 8A shows a sectional view of a three-dimensional jigsaw puzzle 86 made according to an embodiment of the invention in the shape of an apple. This apple puzzle 86 utilizes a single release pin 88 having the appearance of an apple stem. Pushing downward on the stem 88 forces one or more jigsaw puzzle pieces 14 off their structural protrusions 22 and away from the adjacent puzzle pieces 14, allowing easy removal of the remaining puzzle pieces 14. The release pin 88 moves smoothly into a neutral position having the characteristics of a typical apple stem when the puzzle piece 14 is replaced. This release pin utilizes détente pins 84 as a stop on both ends to prevent the release pin 88 from coming fully out of the structural assembly 83 as illustrated in FIG. 8B.

Figure 9A:
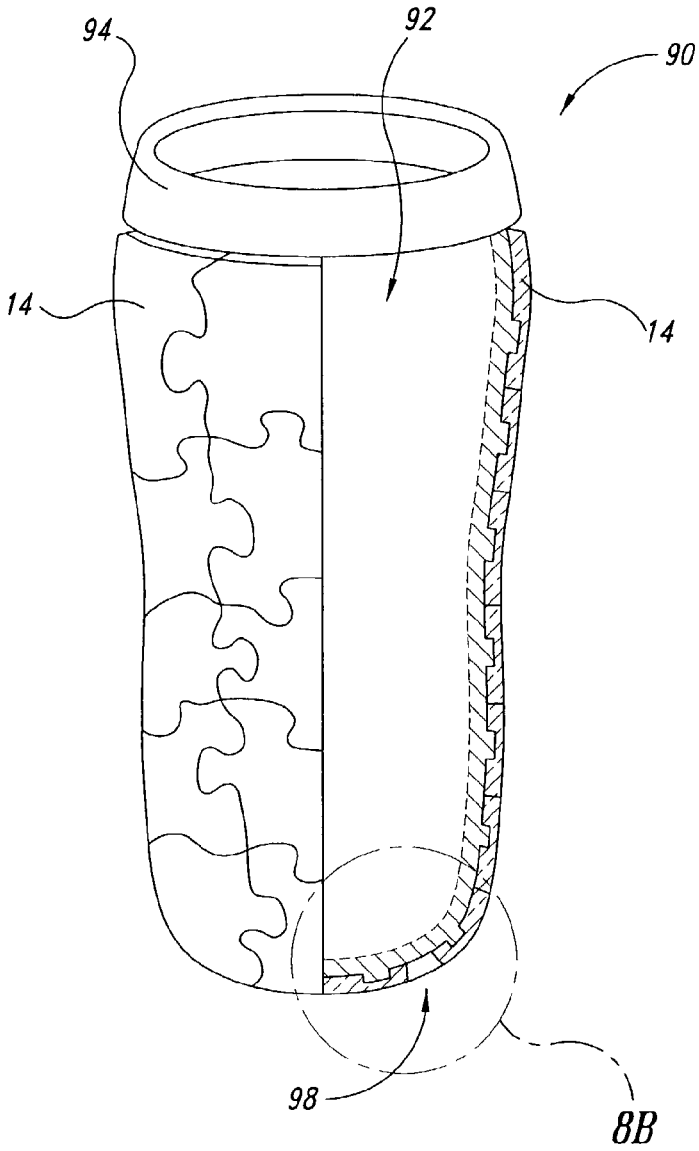
FIG. 9A is a side view of a partially disassemble coffee mug puzzle formed in accordance with another embodiment of the invention.

FIG. 9 shows a sectional view of a three-dimensional jigsaw puzzle 90 made according to an embodiment of the invention in the shape of a coffee mug. This coffee mug puzzle 90 has a hollow interior 92 and screw on cap 94 and can be used as a regular coffee mug. The puzzle 90 may have puzzle pieces 14 covering a central region only, in a manner similar to that illustrated in FIGS. 1 and 6, or the puzzle 90 may include pieces covering the entire outer surface of the puzzle 90, as illustrated in FIG. 9A.

Figure 9B:
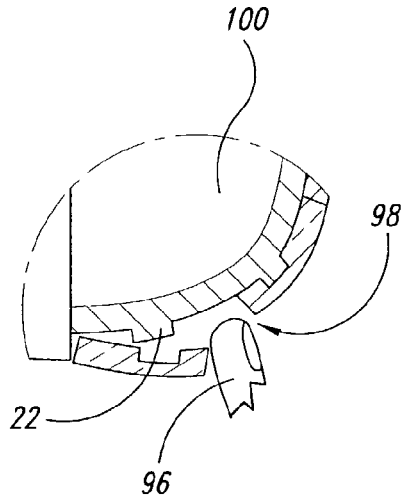
FIG. 9B is an enlarged sectional view of the preferred release method of the coffee mug puzzle of FIG. 9A.

The coffee mug puzzle 90 is disassembled, as illustrated in FIG. 9B, by inserting a finger tip 96 into a recessed area 98 in the base 100 of the puzzle 90 and pushing outward to force one or more pieces 14 off their structural protrusions 22 and away from the adjacent jigsaw puzzle pieces 14, allowing easy removal of the remaining puzzle pieces 14. These coffee mug puzzles 90 may include features, such as handles, to enhance the usability of the puzzle 90 as a regular coffee mug without departing from the spirit and scope of this invention.

Figure 10:
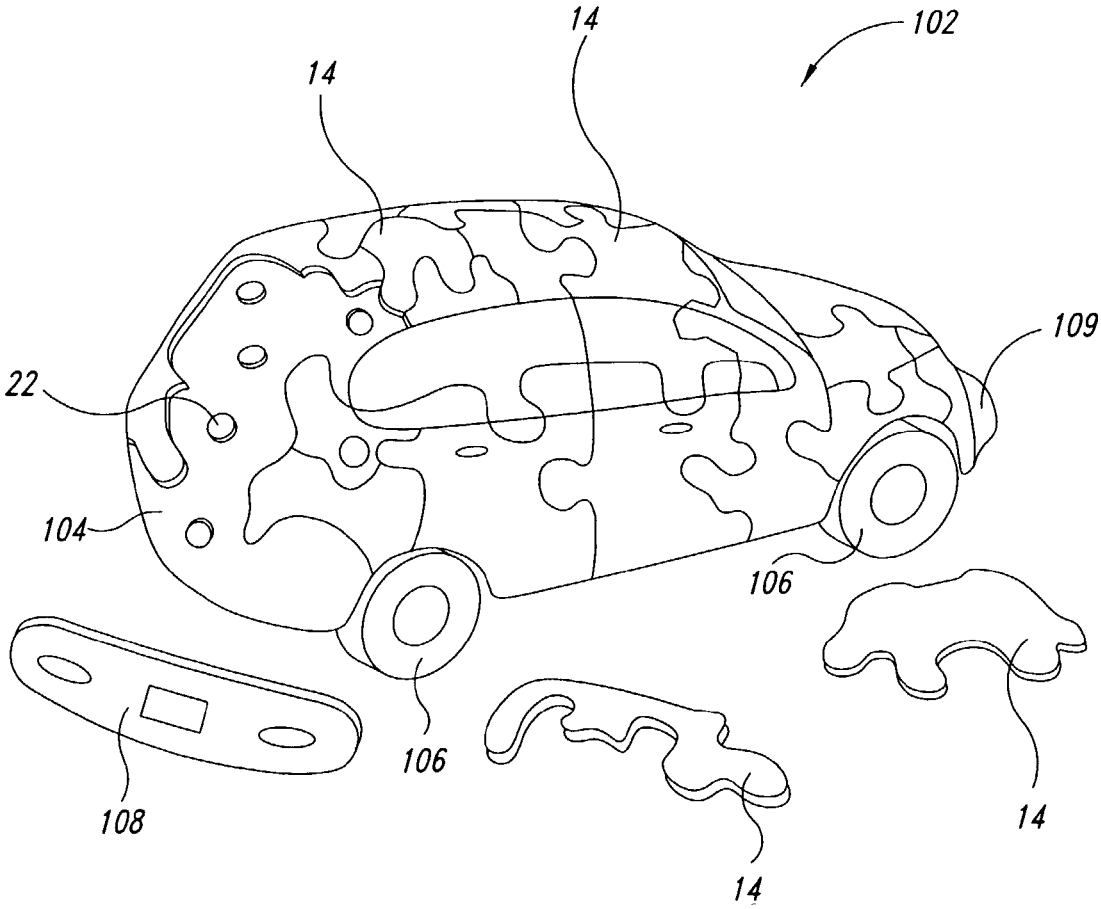
FIG. 10 is a side view of a partially disassemble model car puzzle formed in accordance with another embodiment of the invention.

FIG. 10 illustrates a partially disassembled three-dimensional jigsaw puzzle 102 made in the shape of a scale model of a popular car and having a structure 104 that is designed to accommodate add on pieces, such as wheels 106, bumpers 108, 109 and other pieces, to enhance the likeness of the original vehicle. This puzzle 102 can be disassemble by removing the rear bumper 108 and using the tip of a finger or other means to force the pieces 14 away from the structural protrusions 22 and the adjacent puzzle pieces.

While various embodiments of the invention have been illustrated and described, it is to be understood that changes may be made therein without departing from the spirit and scope of the invention. For example, a single puzzle piece may be permanently attached to the support structure to provide a starting point for assembly of the puzzle. Features described with reference to one embodiment may be combined with those of another embodiment, including methods of manufacture and means for release of the pieces from the structural supports. Furthermore puzzles having the shape and appearance of other familiar objects also fall within the scope of the invention. From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The invention claimed is:

1. A puzzle in the shape of a familiar object, the puzzle comprising:

a substrate having an outer surface with a three-dimensional shape in the form of the familiar object;

a plurality of rigid, non-planar interlocking pieces having a substantially uniform thickness and configured to interlock together and to be coupled to the corresponding outer surface of the substrate, completing, thereby, a representation of the familiar object, each piece of the plurality of pieces configured to contact the outer surface of the substrate over substantially an entire inner surface of the piece; and means for releasing at least one of the plurality of pieces from its coupled relationship with the substrate and from its interlocked relationship with the others of the plurality of pieces.

2. A puzzle in the shape of a familiar object, the puzzle comprising:

a substrate having an outer surface with a three-dimensional shape in the form of the familiar object;

a plurality of rigid, non-planar interlocking pieces having a substantially uniform thickness and configured to interlock together and to be coupled to the outer surface of the substrate, completing, thereby, a representation of the familiar object, each of the plurality of pieces being configured to contact the outer surface of the substrate substantially over an entire inner surface thereof; means for releasing at least one of the plurality of pieces from its coupled relationship with the substrate and from its interlocked relationship with the others of the plurality of pieces; and wherein the familiar object is a soda can.

3. The puzzle of claim 1 wherein the familiar object is a baseball.

4. The puzzle of claim 1 wherein the familiar object is a piece of fruit.

5. The puzzle of claim 1 wherein the familiar object is a bottle.

6. The puzzle of claim 5 wherein the substrate includes a cavity adapted to receive a beverage, and an opening communicating with the cavity and configured to be sealed by a cap.

7. The puzzle of claim 1 wherein the familiar object is a coffee cup.

8. The puzzle of claim 7 wherein the substrate includes a cavity having an opening, the cavity adapted to receive a beverage, and a closable opening.

9. A puzzle in the shape of a familiar object, the puzzle comprising:

a substrate having an outer surface with a three-dimensional shape in the form of the familiar object;

a plurality of rigid, non-planar interlocking pieces having a substantially uniform thickness and configured to interlock together and to be coupled to the outer surface of the substrate, each piece of the plurality of pieces configured to contact the outer surface of the substrate over substantially an entire inner surface of the piece;

means for releasing at least one of the plurality of pieces from its coupled relationship with the substrate and from its interlocked relationship with the others of the plurality of pieces; and wherein the puzzle has substantially the same exterior detail, shape, and dimensions of the familiar object.

10. The puzzle of claim 1, further comprising a component configured to be coupled to the outer surface of the substrate.

11. The puzzle of claim 10 wherein the component comprises one from among a bottle cap, a lid, and a wheel.

12. A three-dimensional puzzle in the form of an object, comprising:

a support structure formed in the shape of the object and having a recessed region on an outer surface thereof;

a plurality of rigid, non-planar pieces configured to interlock together on the support structure in the recessed region;

means for coupling each of the plurality of pieces to the support structure; and means for releasing at least one of the plurality of pieces from its coupled relationship with the support structure and from its interlocked relationship with the others of the plurality of pieces.

13. The puzzle of claim 12 wherein each of the plurality of interlocking pieces has a thickness equal to a depth of the recessed region.

14. The puzzle of claim 12 wherein the object is chosen from among a baseball, a piece of fruit, a toy vehicle, and a beverage container.

15. The puzzle of claim 12, further comprising a weight inside the support structure to give the puzzle a weight substantially equal to the weight of the familiar object.

16. The puzzle of claim 12 wherein the means for coupling comprises a depression formed in a back surface of each of the plurality of pieces and a corresponding projection formed on an outer surface of the support structure, the depression configured to slideably engage the projection.

17. The puzzle of claim 12 wherein the means for coupling comprises a plurality of ridges formed in an outer surface of the support structure and a corresponding feature formed on a back surface of each of the plurality of pieces configured to slideably engage one of the plurality of ridges.

18. The puzzle of claim 12, wherein the puzzle is configured to function substantially as a function of the object.

19. The puzzle of claim 1 wherein the releasing means comprise a space alongside one of the plurality of pieces configured to provide purchase for prying the one piece from the substrate.

20. The puzzle of claim 1 wherein the releasing means comprise:

an aperture passing through a portion of the substrate and terminating in a position corresponding to a location of one of the plurality of pieces;

a rod having first and second ends, slideably positioned in the aperture and having a length such that pressure against the first end of the rod is transferred by the second end of the rod to the one of the plurality of pieces.

21. The puzzle of claim 20, comprising a mechanism for retaining the rod in the aperture when the one of the plurality of pieces is removed from the substrate.

22. The puzzle of claim 1 wherein the puzzle has substantially the same exterior detail, shape, and dimensions of the familiar object.

23. The puzzle of claim 9 wherein the puzzle has substantially the same feel and weight of the familiar object.

24. The three dimensional puzzle of claim 12 wherein the releasing means comprise a mechanism configured to release at least one of the plurality of pieces from its interlocked relationship with the remainder of the plurality of pieces and from its coupled relationship with the support structure.

25. The puzzle of claim 24 wherein the release mechanism comprises a link between first and second ones of the plurality of pieces, such that inward pressure against the first piece results in outward pressure against the second piece, forcing the second piece away from the support structure.

26. A puzzle in the shape of a familiar object, the puzzle comprising:

a substrate having an outer surface with a three-dimensional shape in the form of the familiar object;

a plurality of rigid, non-planar interlocking pieces having a substantially uniform thickness and configured to interlock together on the outer surface of the substrate, completing, thereby, a representation of the familiar object, an inner surface of each piece of the plurality of pieces having an integrally formed feature configured to matingly engage a corresponding feature on the outer surface of the substrate and to contact the outer surface of the substrate substantially over the entire inner surface of the piece; and means for releasing at least one of the plurality of pieces from its coupled relationship with the substrate and from its interlocked relationship with the others of the plurality of pieces.

27. The puzzle of claim 26 wherein the feature of the inner surface of each of the plurality of pieces is configured to matingly engage the corresponding contour on the outer surface of the substrate to a depth of less than the thickness of the respective piece.

28. A puzzle in the shape of a soda can, the puzzle comprising:

a substrate having an outer surface with a three-dimensional shape substantially in the form of the soda can; and a plurality of rigid, non-planar interlocking pieces having a substantially uniform thickness and configured to interlock together and to be coupled to the outer surface of the substrate, completing, thereby, a representation of the soda can; and means for releasing at least one of the plurality of pieces from its coupled relationship with the substrate and from its interlocked relationship with the others of the plurality of pieces.

* * * * *